US007707800B2

(12) United States Patent
Kannisto

(10) Patent No.: US 7,707,800 B2
(45) Date of Patent: May 4, 2010

(54) BEAM CONSTRUCTION AND METHOD FOR MANUFACTURING THE SAME

(75) Inventor: Kari Kannisto, Halli (FI)

(73) Assignee: Runtech Systems Oy (FI)

( * ) Notice: Subject to any disclaimer, the term of this patent is extended or adjusted under 35 U.S.C. 154(b) by 322 days.

(21) Appl. No.: 11/660,238

(22) PCT Filed: Aug. 25, 2005

(86) PCT No.: PCT/FI2005/000366

§ 371 (c)(1),
(2), (4) Date: Feb. 13, 2007

(87) PCT Pub. No.: WO2006/021615

PCT Pub. Date: Mar. 2, 2006

(65) Prior Publication Data

US 2008/0041011 A1 Feb. 21, 2008

(30) Foreign Application Priority Data

Aug. 27, 2004 (FI) ..... 20041123

(51) Int. Cl.
*E04C 5/08* (2006.01)

(52) U.S. Cl. ..... 52/836; 52/223.1; 52/223.8; 52/846

(58) Field of Classification Search ..... 52/223.1, 52/223.8, 433, 650.1, 730.1, 745.17, 223.14, 52/649.2, 726.2, 223.4, 836, 839, 842, 846; 428/53, 98

See application file for complete search history.

(56) References Cited

U.S. PATENT DOCUMENTS

| | | | | |
|---|---|---|---|---|
| 4,537,659 | A | 8/1985 | Koski | |
| 5,483,782 | A * | 1/1996 | Hall | 52/836 |
| 5,791,115 | A * | 8/1998 | Nicolai et al. | 52/843 |
| 5,826,384 | A * | 10/1998 | O'Neill | 52/223.9 |
| 6,361,655 | B1 | 3/2002 | Holopainen et al. | |
| 2002/0102372 | A1 | 8/2002 | Henninger | |

FOREIGN PATENT DOCUMENTS

WO WO 2005/049919 6/2005

* cited by examiner

*Primary Examiner*—Brian E Glessner
*Assistant Examiner*—Patrick Maestri
(74) *Attorney, Agent, or Firm*—Skinner and Associates

(57) ABSTRACT

A beam construction, particularly a so-called doctor beam, for use mainly in pulp and paper mills to carry blade holders (7) intended to hold doctor blades. The beam (1) is a composite-construction hollow beam, which also includes at least one composite construction pre-tensioning rod (9, 10, 12). The construction has an essentially triangular cross-section.

8 Claims, 2 Drawing Sheets

BEAM CONSTRUCTION AND METHOD FOR MANUFACTURING THE SAME

The present invention relates to a beam construction, particularly to a bearer beam construction, such as a doctor beam, and more specifically to a doctor beam that is used mainly in pulp and paper mills to hold in place a doctor blade, which is intended to scrape excess detrimental particles off the top of a roll. The invention also relates to a method for manufacturing the beam construction.

When reference is made to doctor beams in mills like those mentioned above, this nearly always means massive steel beams, which may be of considerable length, as the rolls used in pulp/paper mills can be quite large and the beam typically extends from one end of the roll to the other.

The steel beams are very heavy, which means that all of the structures must be very strong and stiff. Their large size and weight makes the beams difficult to install and maintain. In addition, such a beam is very expensive.

Attempts have also been made to make composite-construction beams, which are lighter than steel beams. One such is disclosed in U.S. Pat. No. 5,356,519, which discloses an essentially triangular beam, in which the structure is formed by three essentially V-shaped pieces rivetted to each other.

The present invention is intended to create an improved doctor beam. The intention is specifically to lighten the beam while at the same time to give it installability and serviceability characteristics of a whole different order to those of known steel beams. The intention is also to improve the stiffness of a composite-construction beam. Naturally, an additional intention is also to reduce the price of the beam.

The aforementioned and other advantages and benefits of the present invention are achieved in the manner described as characteristic in the accompanying Claims In the following, the invention is examined in greater detail with reference to the accompanying patent drawings, which show some of the characteristic features of a beam according to the invention.

Figure 1:
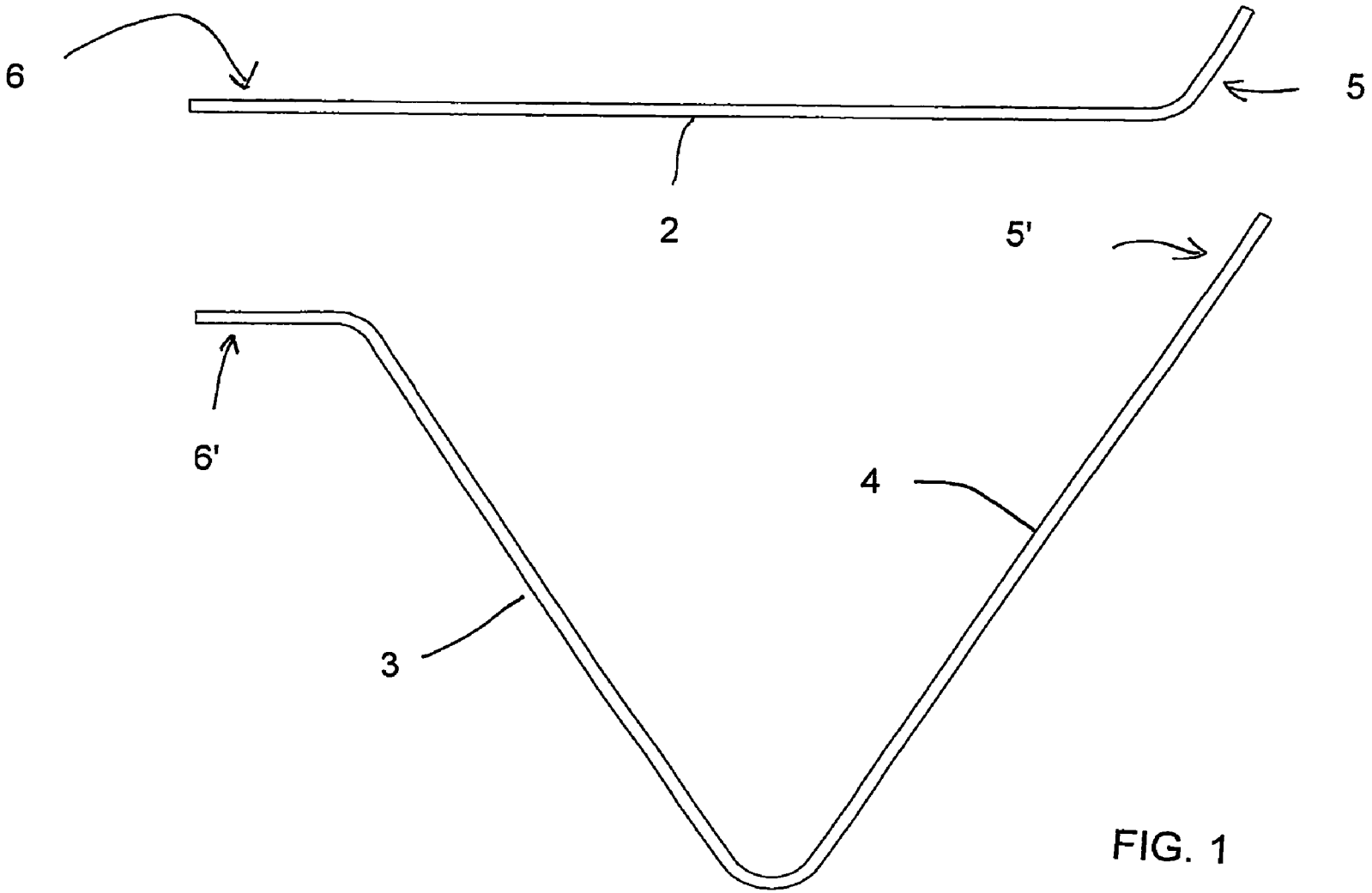
Figure 2:
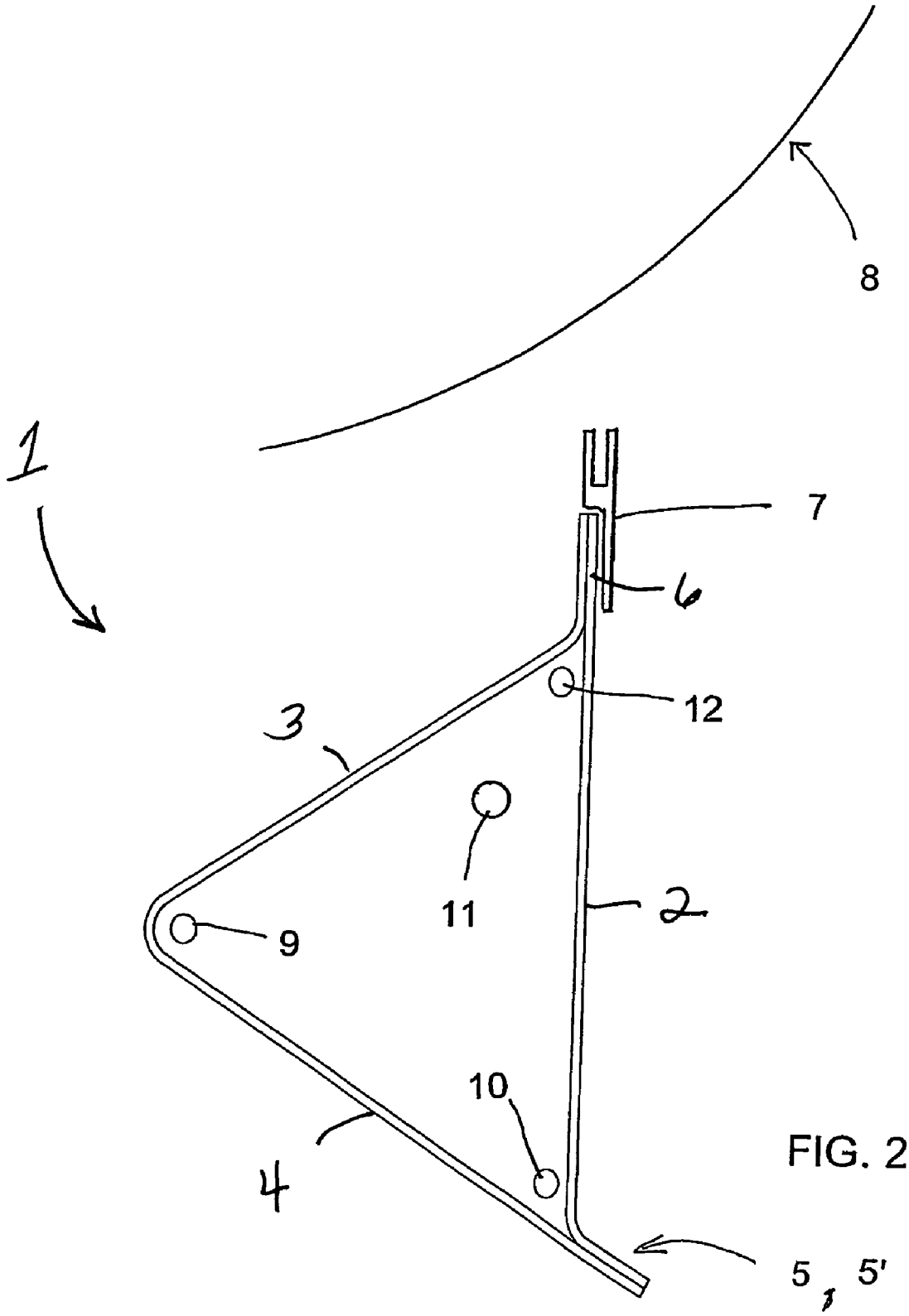

Thus:

FIG. 1 shows one embodiment of the invention, with the main components separated; and FIG. 2 shows a cross-section of the assembled version of the same beam.

The characteristic features of the method according to the invention will become apparent from the following description.

Thus FIG. 1 shows two main components, a first component 2 and a second component 3, 4, of the beam 1 (shown in FIG. 2) according to the invention. The components 2 and 3/4 are manufactured particularly from a so-called pre-preg material using moulding technology in an autoclave. The advantages of moulding technology are the smooth external surfaces, which help to keep the product clean.

The prepreg material is a pre-impregnated so-called B-fabric, in which the impregnating agent is typically an epoxy resin, which in the moulding stage is still in a moldable state. The reinforcement or fabric is, on the other hand, formed from various fibres, most usually glass-fibre and carbon-fibre. The fibre can be oriented as desired, either in one direction or else crosswise in different ways. For example, it is possible to use one-direction tapes, in which case the components of the beam 1 are made by laying the tapes in layers, with the fibres in the different layers crossing each other in different directions. The material is, as such, known and in general use, for example, in the aviation industry. The material is available as a woven fabric and as a tape, i.e. as a one-direction fabric.

In order to be able to have the greatest effect on the strength of the construction, first and second flanges 5 and 6 which come outside the essentially triangular base structure, are formed in the first and second components 2 and 3, 4 respectively, and are brought against each other only in the assembly stage of the beam 1 and, in that stage, are glued onto each other, the joint being secured mechanically, for example, by bolts.

The first component 2 has a linear body with a first end at which the first flange 5 is disposed at an angle. The second component 3-4 has a V-shaped body with an apex and second and third sides 3 and 4, respectively, extending away from the apex to form an open mouth. The second flange 6 is disposed at the extended end of the second side 3. The second flange 6 is oriented at an angle to the side 3, away from the mouth. The first flange portion 5 is connected to the end 5' of the side 4 within the mouth of the V-shaped body, and the second flange portion 6 is connected to the second end 6' of the linear body or side 2. The resultant first and second flange structures 5-5' and 6-6' are thus two layer. In the finished beam 1, the flanges 5, 5' and 6, 6' and act as stiffeners against deflection and vibration, as well as an attachment surface for blade holders 7.

The disclosed manufacturing technique allows the thickness of the materials of the components of the beam to be selected as desired. For example, this can be easily done by laying more layers at points where it is assumed that the stronger material would be advantageous. Obviously, the thickness of the material can be made to vary in both the longitudinal and transverse directions. The deflection, vibration, and similar properties can also be substantially affected by the choice of the type of fabric.

FIG. 2 in turn shows a cross-section of an assembled doctor beam 1 according to the invention. The beam 1 generally forms a triangular structure, in which there are first, second and third sides 2, 3, and 4, respectively. The sides need not necessarily be equally long, in other words, the triangular structure is not equilateral, instead the lengths of the sides are chosen by taking into account deflection and vibration properties, as well as the available space. It is simple to fit the beam according to the invention to existing structures, as the dimensions of its structure can be changed relatively easily. As can be clearly seen from the description of FIG. 1 , the beam 1 according to the invention has a composite construction.

The second flange component 6 of the assembled beam is used to attach the holder 7 of the doctor blade. The doctor blade, which is not marked in the figure, rests on the surface of the roll 8 being doctored, at a short distance from the holder 7.

FIG. 2 shows pre-tensioning rods 9, 10, and 12, with the aid of which both the deflection and the torsion of the beam 1 can be controlled simply, by tightening/loosening the pre-tensioning rods. The pre-tensioning rods 9, 10 and 12 too are made from a composite material that corresponds to the construction of the beam 1. This ensures that incompatibility of the materials will not, for example due to temperature variations, alter the adjustment values so as to detrimentally affect how they operate, or the end result of the work they perform. There is at least one, and optimally three pre-tensioning rods. Two pre-tensioning rods can also be used. The locations of particularly the three rods are close to the corners of the beam 1, which is essentially triangular.

Various conventional means, mainly screws, which can be adjusted to change the tension in the pre-tensioning rods, exist for tensioning and adjusting the pre- tensioning rods 9, 10 and 12.

In the above, the figures show only one cross-sectional form, though it is exceptionally good and appropriate for this purpose. However, the invention is not restricted to this form, instead, as is known, many other cross-sectional or other shapes can be used to create strong constructions. Various kinds of reinforcing ridges, grooves, or similar can also be used to strengthen the construction. If composite-construction and steel beams are compared to each other in terms of weight and installability, it will be noted that the composite construction is light and slim, even though no kind of reinforcing structure whatever is added to it in practice.

If desired, an adhesive can be led inside the beam according to the invention, for example a hot adhesive to prevent the beam sweating and to promote ventilation in general. The air can be fed mechanically, but even spontaneous ventilation can be created, by making holes oriented in a rational manner at suitable points in the beam. The orientations can be affected by many factors in the beam and its surroundings. One air-feed connection is marked with the reference number 11 in FIG. 2.

The invention claimed is:

1. A composite-construction doctor beam, for use in pulp and paper mills to carry blade holders adapted to hold doctor blades, comprising, a beam consisting of two separate components constructed of a glass or carbon fibre impregnated with an epoxy resin that are attached to each other, the first beam component having a linear body defining a first side and with a first flange portion disposed at a first end of the linear body at an angle to the linear body, the second beam component having a V-shaped body with an apex and second and third sides extending away from the apex to define a mouth portion and having a second flange portion disposed at the end of the second side extending at an angle away from the mouth, the first flange portion being connected to the V-shaped body within the mouth thereof, and the second flange portion being connected to the second end of the linear body, whereby the beam has a triangular configuration with a hollow interior, the beam further having a first, two layer flange constructed of the first flange portion and the end of the third side of the V-shaped body, and a second two layer flange constructed of the second flange portion and the first end of the linear body;

the layers of the first and second flanges being connected to each other by gluing and by mechanical fasteners;

at least one composite construction pre-tensioning rod disposed in the hollow interior of the beam; and a doctor blade holder connected to the second flange.

2. The beam construction according to claim 1 , characterized in that there are three pre-tensioning rods.

3. The beam construction according to claim 1, characterized in that the pre- tensioning rods are located inside the beam near the corners of the triangle.

4. Beam construction according to claim 1, characterized in that the first flange is oriented in-line with the third side and the second flange is flat and oriented in-line with the first side, and wherein the doctor-blade holder is oriented in-line with the second flange.

5. The beam construction according to claim 1, characterized in that it includes holes for ventilating the interior space of the beam and/or a connection for leading a mechanical airflow into the beam.

6. A method for manufacturing a composite-construction doctor beam, which is adapted to be used for carrying blade holders to hold the doctor blades for rolls of pulp and paper mills, comprising the steps of, constructing two separate composite-construction components of a glass or carbon fibre impregnated with an epoxy resin, the first beam component having a linear body defining a first side and with a first flange portion disposed at one end at an angle to the body, the second beam component having a V-shaped body with an apex and second and third sides extending away from the apex to define a mouth portion and having a second flange portion disposed at the end of one side extending at an angle away from the mouth;

attaching the components to each other, in order to form an essentially triangular structure, the first flange portion being connected to the V-shaped body within the mouth thereof, and the second flange portion being connected to the linear body, whereby the beam has a triangular configuration with a hollow interior, the beam further having a first, two layer flange constructed of the first flange portion and a side of the V-shaped body. and a second two layer flange constructed of the second flange portion, wherein the linear body the layers of the first and second flanges are connected to each other by gluing and by mechanically fasteners;

disposing at least one composite-construction pre-tensioning rod inside the hollow interior of the triangular beam structure; and connecting a doctor blade holder to the second flange.

7. The method according to claim 6, characterized in that the beam is equipped with three composite-construction pre-tensioning rods, which are located inside the hollow interior of the beam construction near to its corners.

8. The method according to claim 6, characterized in that the components are manufactured by laminating one-direction reinforcement, in which the reinforcing fibres lie in the same directions, in a manner with the different directions crossing each other.

* * * * *